United States Patent [19]

Rangaswamy

[11] Patent Number: 4,795,148

[45] Date of Patent: Jan. 3, 1989

[54] COMBINATION OF ANTISTASIS DEVICES

[76] Inventor: Avvari Rangaswamy, P.O. Box 426, Littleton, N.C. 27850

[21] Appl. No.: 33,800

[22] Filed: Apr. 3, 1987

Related U.S. Application Data

[63] Continuation-in-part of Ser. No. 632,896, Jun. 20, 1984, Pat. No. 4,669,722, which is a continuation-in-part of Ser. No. 468,971, Feb. 23, 1983, abandoned.

[51] Int. Cl.[4] ..... A63B 23/04

[52] U.S. Cl. ..... 272/96; 272/138; 128/25 B

[58] Field of Search ..... 272/70, 96, 136, 138, 272/139; 128/25 B, 24, 24.1, 24.2

[56] References Cited

U.S. PATENT DOCUMENTS

| | | | |
|---|---|---|---|
| 3,295,847 | 1/1967 | Matt, Sr. | 272/96 |
| 3,421,760 | 1/1969 | Freeman, Jr. | 272/96 |
| 3,524,643 | 8/1970 | Hazelitt, Sr. | 272/96 |
| 3,525,522 | 8/1970 | Piller | 272/96 |
| 3,741,540 | 6/1973 | Shimizu | 272/96 |
| 4,215,679 | 8/1980 | Rostin | 128/25 B |
| 4,229,001 | 10/1980 | Roman | 272/96 |
| 4,669,722 | 6/1987 | Rangaswamy | 272/138 |

FOREIGN PATENT DOCUMENTS

| | | | |
|---|---|---|---|
| 2744996 | 4/1979 | Fed. Rep. of Germany | 272/96 |

*Primary Examiner*—Richard J. Apley
*Assistant Examiner*—Robert W. Bahr
*Attorney, Agent, or Firm*—Gilbert L. Wells

[57] ABSTRACT

An exercise device for the feet and legs, where the device has foot plates for exercising a supine person's feet; calf squeezers for compressing the calf muscles when the feet are exercised; and a support structure holding the foot plates in a vertical position and the calf squeezers in a horizontal position.

Persons in a supine position exert a rocking movement of the foot plates and this rocking movement makes the calf muscles squeeze against the calf squeezer. This squeezing pumps blood out of the deep veins of the calf and prevents stasis of blood and clot formation in the deep veins of the calf.

13 Claims, 3 Drawing Sheets

COMBINATION OF ANTISTASIS DEVICES

CROSS-REFERENCE TO RELATED APPLICATIONS

The present invention is a continuation-in-part of application Ser. No. 632,896 filed June 20, 1984, now U.S. Pat. No. 4,669,722, which in turn is a continuation-in-part of application Ser. No. 68,971 filed Feb. 23, 1983, now abandoned.

BACKGROUND OF THE INVENTION

The field of the invention is exercising devices for the foot and leg and the present invention is particularly concerned with a combination of antistasis devices for maintaining circulation in the foot and leg.

Invalids and bedridden people, whose opportunities for leg exercise are severely limited, are subject to an increased risk of thrombophlebitis which is defined as an inflammation of a vein with the formation of a thrombus (blood clot). Thrombophlebitis can eventually lead to pulmonary embolism.

The most common location for the formation of such clots is found in the deep veins of the legs where pooling and stagnation of blood occurs due to poor circulation as a result of little or no leg exercise. Exercising of the leg muscles, especially the calf muscles, facilitates the movement of blood in the deep veins of the leg, thus lessening the risks of blood clot formation.

It has been common practice to massage the legs of invalids and bedridden patients in order to maintain leg muscle tone and circulation, which in turn decreases the risk of thrombophlebitis. However, due to the shortage of nurses and physical therapists, patients may not receive the necessary routine massages or leg exercises.

Apparatuses for massaging or exercising legs have been too cumbersome and/or expensive to be widely available in most hospitals and are especially not readily available to non-hospitalized patients.

Lowth in U.S. Pat. No. 4,159,111 discloses a leg exercising apparatus which is supposed to approximate a walking motion. The apparatus consists of two solid, one piece, hinged foot pedals connected to each other through a pivotal point. As one pedal is pushed down it forces the other pedal to rise. Since each hinged pedal is a solid unit, without any flexibility, the exerciser's foot does not flex, as in normal walking, unless the heel leaves the foot pedal. Therefore, when using the Lowth apparatus the leg muscles, especially the calf muscles, do not contract to the same degree as in walking when there is a flexing of the foot. There is also a second disadvantage associated with the Lowth apparatus in that when the apparatus is used by a patient in the supine position, the patient's feet have a tendency to slip off the pedals.

A second exercising device is disclosed by Wood in U.S. Pat. No. 1,990,970. Here, weights are added to a shoe having rigid sole portions. Again, the shoe has a solid unitary body providing no flexibility. This arrangement is useful for people in good physical condition, who want to use the apparatus for strengthening leg muscles. The Wood apparatus, however, is not conducive for use by invalids or bedridden patients who require an apparatus for contracting and stretching leg muscles as opposed to an apparatus which is intended to build muscle mass.

Although the apparatuses of U.S. Pat. Nos. 1,990,970 and 4,159,111 are supposedly designed to exercise leg muscles, neither apparatus incorporates features, other than movement of the foot about the ankle joint, to exercise calf muscles. As stated above, however, in order to facilitate the pumping of blood from deep veins, the calf muscles are contracted and extended. For the non-invalid, such exercises of calf muscles is provided by walking where the foot is flexed about both the ankle joint and about the ball of the foot. For the reasons advanced above, neither of the above described apparatuses provides an efficient leg exerciser for preventing thrombophlebitis in invalids or bedridden patients.

SUMMARY OF THE INVENTION

The present invention is an efficient leg exerciser for use by invalids and bedridden patients, which provides a mimicking of the normal walking sequence. In part, this is accomplished by the present invention providing a surface against which the posterior calf muscles are constrained, thus "squeezing" the muscles and facilitating a more efficient pumping action of the blood in the deep veins.

Three elements are combined in the present invention to prevent stasis in supine persons. These elements comprise:

(1) a support structure;
(2) calf squeezers; and
(3) foot plates.

The support structure comprises a horizontal panel and a vertical panel and the vertical panel is hinged to the horizontal panel, there are no grooves on the horizontal panel or vertical panel.

The calf squeezers consist of semirigid foam glued to a rigid, semicircular plastic frame. The plastic frame is rigid and is fitted to the horizontal panel of the support frame by means of screws. The calf squeezers are provided with wraps to wrap the leg snugly around the calf squeezer. The semirigid foam layer is covered with satin or similar material to provide a smooth surface to the calf of the user.

Each of the foot plates consists of a pair of flat plates that are kept in a spaced apart relationship by means of a hollow metallic tube welded to the lower foot plate made of steel. The welding of the hollow tube to the lower metallic plate is slightly below the center. The top foot plate is suitably made of plastic and covered with a soft lining (made of synthetic cloth, such as nylon or natural cloth, such as silk). This soft lining provides comfort to the sole of the user. The upper plastic plate is held to the lower metallic plate by means of two elastic bands, one at the toe end and the other at the heel end. The lower metallic plate is fixed to the vertical panel by means of screws or magnets. The foot is held attached to the upper plastic plate by means of straps, belts or VELCRO.

There are important differences between the present invention and the antistasis device disclosed in application Ser. No. 632,896. These differences include:

(1) The foot plates and the calf squeezer of the present invention (with the wrap that goes around the leg) are not a unitary structure and are not in a unitary relationship. The foot plates that are held in the vertical position against the vertical panel can be removed from the vertical panel independently of the calf squeezer.

(2) The calf squeezer consists of a thick (½" to 1" thick) semirigid foam glued to a rigid semicircular plastic frame. This plastic frame is fixed to the horizontal panel by a plurality of screws. The semirigid foam layer is covered with satin or similar material to provide a smooth surface to the calf. The calf squeezer as described above stops just above the ankle joint and is not in continuity with the foot plates.

(3) The plastic upper foot plate has a plurality of magnetic strips fixed to its toe end and the heel end. These magnetic strips facilitate the rocking movement of the foot (strapped to the upper plastic plate by VELCRO in belts) as the lower metallic foot plate attracts the horizontal magnetic strips at the toe end and the heel end of the upper plastic foot plate.

BRIEF DESCRIPTION OF THE DRAWINGS

The present invention may best be described by reference to the appended drawings, wherein.

DESCRIPTION OF THE PREFERRED EMBODIMENTS

Figure 1:
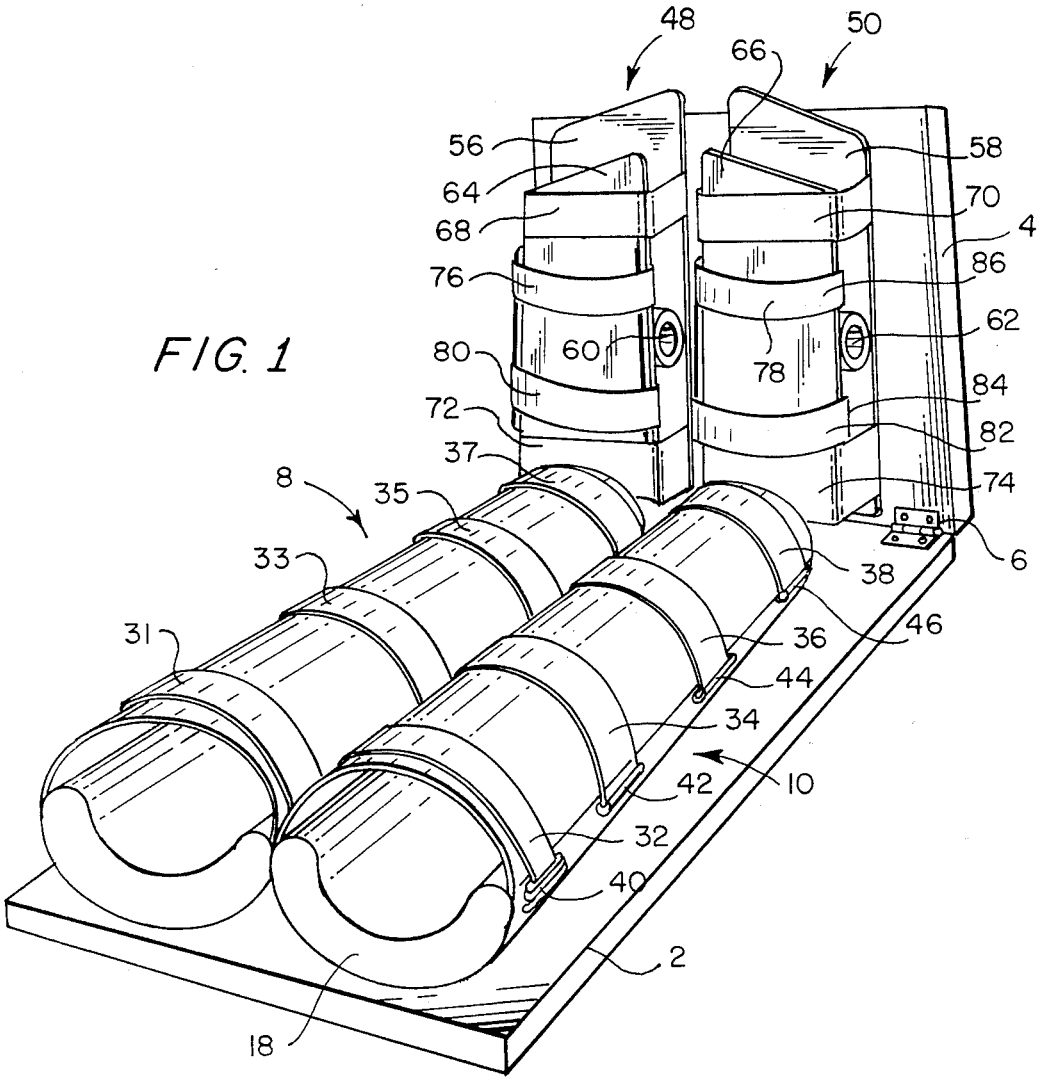
FIG. 1 is a right side perspective view of the combination of antistasis devices.

With particular reference to FIG. 1, the horizontal panel 2 is shown attached to vertical panel 4 by hinges 6.

Figure 2:
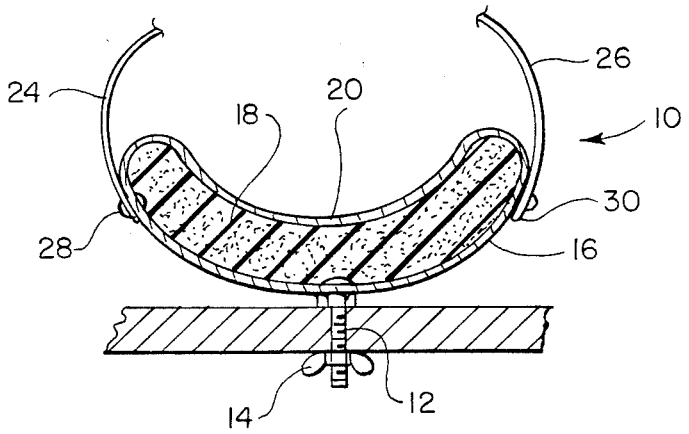
FIG. 2 is a cross-sectional view of one of the calf squeezers of the present invention.

Calf squeezers 8 and 10 are secured to horizontal panel 2 by bolts or screws 12 having wing nuts 14, as shown in FIG. 2.

Each calf squeezer has a rigid semicircular plastic frame 16 with a semirigid foam 88, such as polyurethane, glued therein. The semirigid foam is covered with satin or similar material 20 which provides a smooth surface for the calf of a user. Flaps 24 and 26 are secured to the semicircular plastic frame 16 by a plurality of rivets 28 and 30.

VELCRO fasteners are suitably mounted on the outside of flap 24 and the inside of flap 26 for fitting the calf of a user in the calf squeezer.

In addition to the VELCRO fasteners, a plurality of straps 31 to 38 are secured at one end by rivets to the semicircular plastic frame and through D-rings 40-46 at the other end to provide a more secure retention of the user's calves in the calf squeezers.

Figure 3:
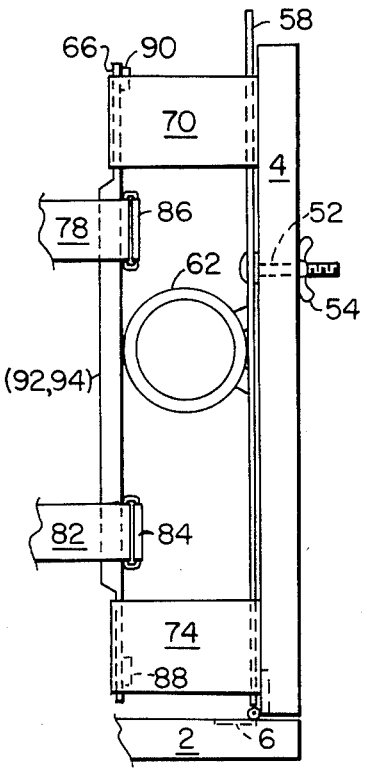
FIG. 3 is a right side view of one of the foot plates of the present invention secured to the vertical panel by a screw with wing nut.
Figure 4:
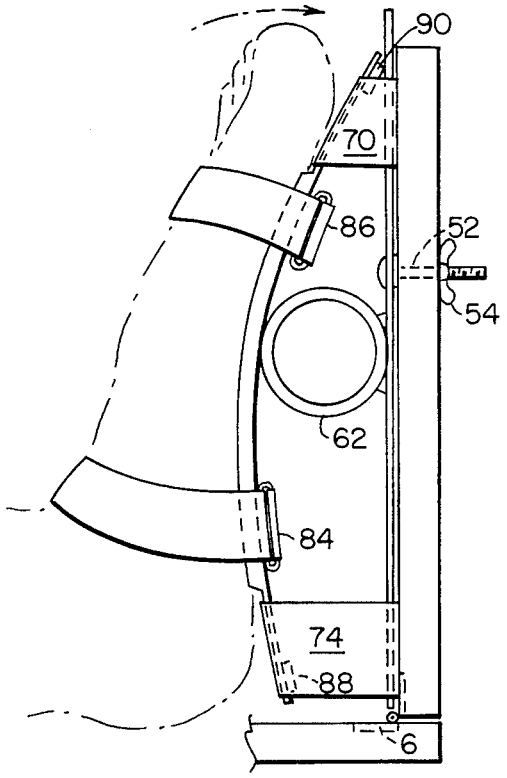
FIG. 4 is a right side view of one of the foot plates of the present invention in use with the toes of the foot depressed.
Figure 5:
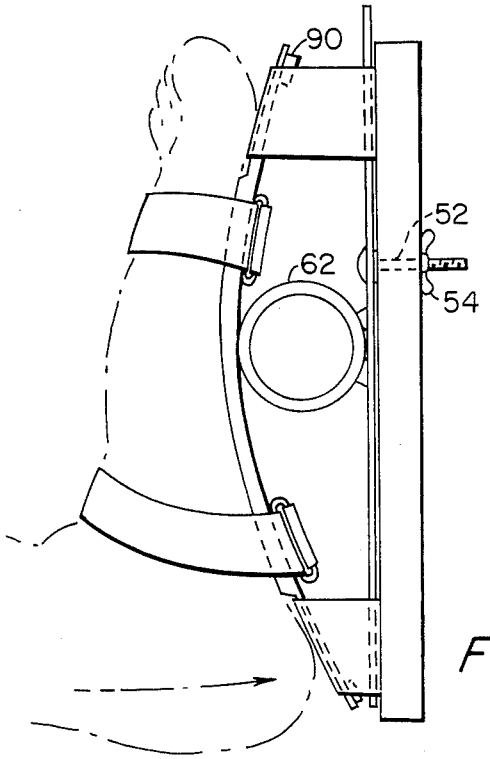
FIG. 5 is a right side view of one of the foot plates of the present invention in use with the heel of the foot depressed.

Foot plates 48 and 50 are held in place on vertical panel 4 by magnets or bolts 52 with wing nuts 54, as shown in FIGS. 3 to 5. Each foot plate has a metal bottom plate (56,58) with a hollow metal tube (60,62) welded to the metal plate approximately in the middle thereof.

Plastic foot holders (64,66) pivot about the metal tubes (60,62) and are held at the toe and heel portions by elastics 68-74 encircling the plastic foot holders and metal plates.

Straps 76 to 82 secure the feet of the user to the plastic foot holders. These straps 76 to 82 are secured to one side of the plastic foot holders by rivets and on the other end by D-rings 84 and 86.

Magnets 88 and 90 are attached to the underside of the plastic foot holders and are attracted to metal plate 50. Each foot holder has longitudinal ridges 92,94 on each side thereof to maintain the user's feet in longitudinal direction. The foot holders are covered with a soft lining made from nylon or cloth.

FIG. 4 shows the foot flexed with the toes foreward and the heel to the rear while FIG. 5 shows the heel flexed forward and the toes to the rear. The magnets 88,90 and the elastics 70,74 stress the plastic foot holders and add to the amount of effort required by the user to move his feet between the positions shown in FIGS. 4 and 5.

As the feet are flexed, as shown in FIGS. 4 and 5, the calf muscles of the user are expanded and contracted and pressure is applied to the calf muscles by the calf squeezers 8 and 10.

Figure 6:
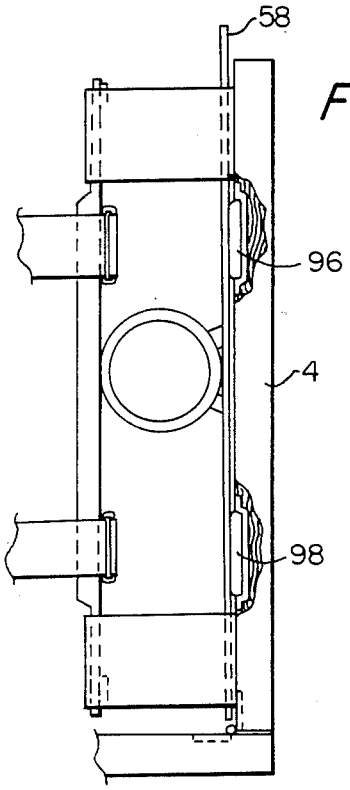
FIG. 6 is a right side view of one of the foot plates of the present invention, partially in cross-section, with the bottom steel plate secured to the vertical panel by magnets.

In FIG. 6, the steel plate 58 is held in position on vertical panel 4 by magnets 96 and 98.

Figure 7:
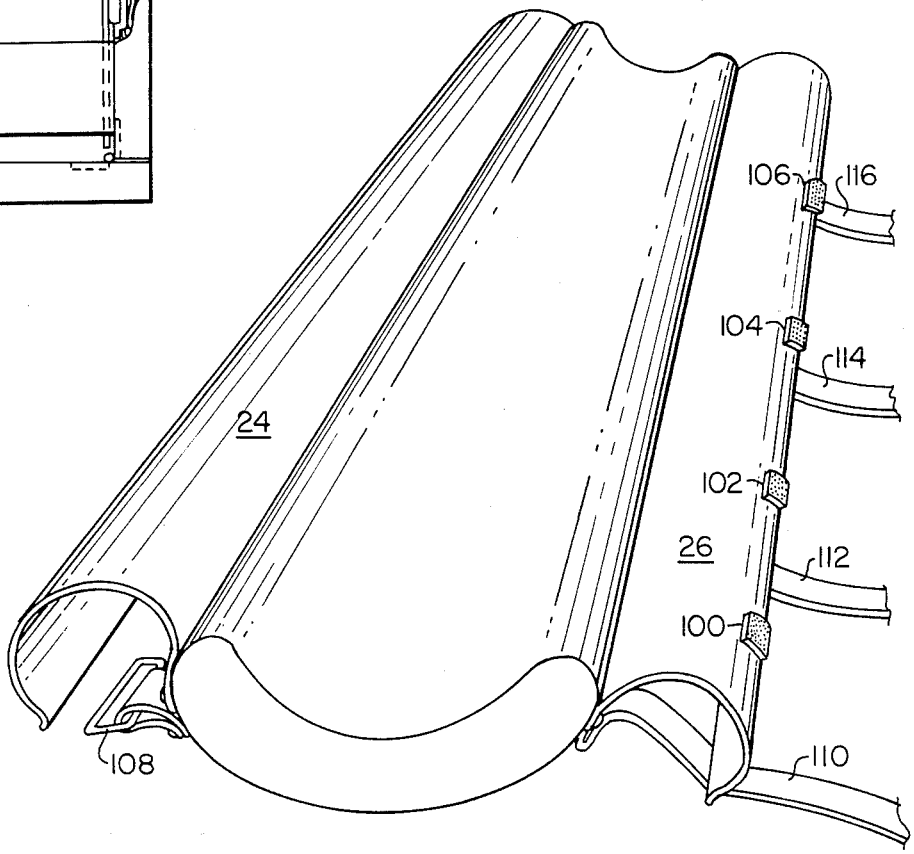
FIG. 7 is a right side perspective view of one of the calf squeezers shown in an open position.

FIG. 7 shows a calf squeezer of FIGS. 1 and 2 with covers 24 and 26 open and VELCRO TM fasteners 100 to 106 exposed. One D-ring 108 and straps 110 to 116 are also shown.

BEST MODE OF CARRYING OUT THE INVENTION

A patient is placed in a supine position the feet are strapped to the upper plastic foot plates by VELCRO TM and belts. The legs fit snugly into the calf squeezers and are wrapped around with the leg wraps provided.

The patient then exerts a rocking movement of the foot plates held against the vertical frame. This rocking movement makes the calf muscle squeeze against the semirigid foam layer of the calf squeezer and this squeezing of the calf muscles pumps the blood out of the deep veins of the calf and prevents stasis (stagnation) of blood and clot formation in the deep veins of the calf. The currents in the blood flow created by squeezing the calf against the semirigid layer of the calf squeezer spread to the proximal veins, namely, Femoral and Ileac veins and prevent stagnation of blood and clot formation in these veins also.

The overall effects of the antistasis device is to prevent pulmonary embolism by preventing stasis and clot formation in the deep veins of the calf and proximal Femoral and Ileac veins.

I claim:

1. An antistasis device for use in the supine position comprising:

(a) a horizontal panel and a vertical panel and a vertical panel attached to each other to form a frame apparatus;

(b) means for squeezing the user's calf including resilient means conforming to the calf of the user and means for securing the calf of the user against the resilient means, said means for squeezing the user's calf being removably attached to said horizontal panel; and, (c) means for flexing the user's foot including a base plate removably secured to said vertical panel, a metal tube secured to said base plate, and a foot folding plate, formed of a non-magnetic material, held in pivotable relationship about said tube.

2. The antistasis device of claim 1, wherein said means for squeezing the user's calf comprises a rigid semicircular plastic frame, a semirigid foam attached to the inside of said plastic frame, covers attached to both sides of said plastic frame and means for securing said covers over the leg of a user.

3. The antistasis device of claim 2, wherein said covers are secured to one another by hook and loop fasteners.

4. The antistasis device of claim 2, wherein said covers are secured to one another by straps.

5. The antistasis device of claim 2, wherein said plastic foam has a smooth surface thereover.

6. The antistasis device of claim 1, wherein said foot holding plate is comprised of plastic having magnets at both ends thereof and said pivotable relationship is accomplished by elastics passing around the forward ends and rear ends of said base plate and said foot holding plate.

7. The antistasis device of claim 6, wherein said foot holding plate has longitudinal ridges thereon.

8. The antistasis device of claim 1, wherein said horizontal panel is attached to said vertical panel by hinges.

9. The antistasis device of claim 1, wherein said tube is hollow.

10. The antistasis device of claim 1, wherein said metal base plate is secured to said vertical panel by magnets in said vertical panel.

11. The antistasis device of claim 1, wherein said metal base plate is secured to said vertical panel by bolts.

12. The antistasis device of claim 1, wherein said means for squeezing the user's calf is secured to said horizontal panel by bolts.

13. An antistasis device for use in the supine position comprising:

(a) a horizontal panel and a vertical panel and a vertical panel attached to each other to form a frame apparatus;

(b) means for squeezing the user's calf including a pair of resilient means conforming to the calf of the user and means for securing a calf of the user against each of the resilient means, said means for squeezing the user's calf being removably attached to said horizontal panel; and, (c) means for flexing the user's foot including a pair of base plates removably secured to said vertical panel, each base plate having a metal tube secured to said base plate, and a foot holding plate, formed of a non-magnetic material, held in pivotable relationship about said tube.

* * * * *